United States Patent [19]

Smith

[11] 4,005,231

[45] Jan. 25, 1977

[54] TREATMENT OF FIBRES

[75] Inventor: Charles Smith, South Glamorgan, Wales

[73] Assignee: Dow Corning Limited, Barry Glamorgan, Wales

[22] Filed: May 15, 1975

[21] Appl. No.: 577,583

[30] Foreign Application Priority Data

May 28, 1974 United Kingdom ..... 23480/74

[52] U.S. Cl. ..... 427/387; 260/46.5 G; 427/389

[51] Int. Cl.[2] ..... B05D 3/02

[58] Field of Search ..... 260/46.5 G; 427/387, 427/389

[56] References Cited

UNITED STATES PATENTS

| | | | |
|---|---|---|---|
| 2,728,692 | 12/1955 | Bennett | 427/389 X |
| 2,732,320 | 1/1956 | Guillissen | 427/389 X |
| 2,927,870 | 3/1960 | Beutler | 427/389 X |
| 2,980,557 | 4/1961 | LaFlear | 427/389 X |
| 3,009,833 | 11/1961 | Somerville | 427/389 X |
| 3,345,195 | 10/1967 | Simpson | 427/389 X |

FOREIGN PATENTS OR APPLICATIONS 2,335,751 7/1973 Germany

*Primary Examiner*—Michael R. Lusignan
*Attorney, Agent, or Firm*—Robert F. Fleming, Jr.

[57] ABSTRACT

Composition for application to keratinous fibres to impart resistance to shrinking. The composition comprises (A) a hydroxylated polydiorganosiloxane having a molecular weight of at least 750(B) an organosilane having alkoxy groups and an organic substituent containing at least 2 amine groups, and/or a partial hydrolysate and condensate of the organosilane, and (C) an organic or organosilicon compound containing at least one hydroxyl radical bonded to an aliphatic carbon atom.

The composition may also contain a further organosilane e.g. methyltrimethoxysilane and/or its partial hydrolysis and condensation product.

7 Claims, No Drawings

TREATMENT OF FIBRES

This invention relates to a process and composition for the treatment of keratinous fibres.

In German Offenlegungschrift No. 2,335,751 there is described a method for rendering keratinous fibres shrink resistant, which method, described briefly, comprises applying to the fibres from 0.1 to 10% by weight, based on the weight of the fibres, of a composition comprising the product obtained by mixing (A) a polydiorganosiloxane having terminal silicon-bonded hydroxyl radicals and (B) an organosilane having a monovalent radical containing at least two amine groups. The preferred compositions for use in the process described in said Offenlegungschrift also contain a silane having silicon-bonded alkoxy or alkoxy-alkoxy radicals and/or a partial hydrolysate and condensate of such a silane.

A particularly convenient method of treating keratinous fibres with the said compositions is by application from an organic solvent solution employing a conventional dry cleaning machine. It has been found however that this method of application can result in a progressive build up of cured composition in certain locations in the machine. This build up is generally associated with loose fibres and can cause blockages in the cage, button trap, filters and feed pipes. Such blockages are difficult to remove and there has consequently existed a need for a means of retarding or minimising the build up of cured siloxane during said treatment process. We have now unexpectedly fount that this object may be achieved by including in the treating composition a substance having at least one hydroxyl radical bonded to an aliphatic carbon atom.

Accordingly this invention provides an improved process for the treatment of keratinous fibres which comprises applying thereto from 0.1 to 10% by weight of a composition comprising the product obtained by mixing (A) a polydiorganosiloxane having terminal silicon-bonded hydroxyl radicals and a molecular weight of at least 750, at least 50% of the organic substituents in the polydiorganosiloxane being methyl radicals, any other organic substituents being monovalent hydrocarbon radicals having from 2 to 30 carbon atoms, (B) an organosilane of the general formula $RSiR'_nX_{3-n}$ wherein R represents a monovalent radical composed of carbon, hydrogen, nitrogen and, optionally, oxygen, which radical contains at least two amine groups and is attached to silicon through a silicon to carbon linkage, R′ represents an alkyl radical or an aryl radical, each X represents an alkoxy radical having from 1 to 14 inclusive carbon atoms and $n$ is 0 or 1, and/or a partial hydrolysate and condensate of said organosilane, and (C) from 1 to 15% by weight based on the total weight of (A) and (B) of an organic or organosilicon compound containing at least one hydroxyl radical attached to an aliphatic carbon atom, and thereafter curing the applied composition.

The polydiorganosiloxanes (A) are linear or substantially linear siloxane polymers having terminal silicon-bonded hydroxyl radicals. Such polydiorganosiloxanes have about two, that is from about 1.9 to 2, organic radicals per silicon atom and methods for their preparation are well known in the art. The polydiorganosiloxanes should have an average molecular weight of at least 750 and preferably from 20,000 to 90,000.

At least 50 per cent of the silicon-bonded organic substituents in the polydiorganosiloxane are methyl, any other substituents being monovalent hydrocarbon radicals having from 2 to 30 carbon atoms, for example alkyl and cycloalkyl radicals, e.g. ethyl, propyl, butyl, n-octyl, tetradecyl, octadecyl and cyclohexyl, alkenyl radicals e.g. vinyl and allyl and aryl, aralkyl and alkaryl radicals e.g. phenyl, tolyl and benzyl. A small proportion of hydroxyl radicals may be attached to non-terminal silicon atoms in the polydiroganosiloxane. However, such non-terminal hydroxyl radicals should preferably not exceed about 5% of the total substituents in the polydiorganosiloxane. The preferred polydiorganosiloxanes are the polydimethylsiloxanes i.e. those represented by the formula

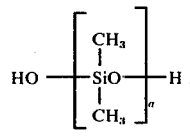

in which $a$ is an integer preferably having a value such that the polydiorganosiloxane has a viscosity of from 100 to 50,000 cS at 25° C.

Component (B) of the compositions employed in the process of this invention is an organosilane of the general formula $RSiR'_nX_{3-n}$ wherein R, R′, X and $n$ are as defined hereinabove, or it may be a partial hydrolysate and condensate of said organosilane. Such organosilanes are known substances and they may be prepared as described in, for example, U.K. Patents Nos. 858,445 and 1,017,257. In the general formula of the organosilanes the radical R is composed of carbon, hydrogen, nitrogen and, optionally, oxygen and contains at least two amine groups. The radical R is attached to silicon through a silicon to carbon linkage, there being preferably a bridge of at least 3 carbon atoms separating the silicon atom and the nearest nitrogen atom or atoms. Preferably also, R contains less than about 21 carbon atoms and any oxygen is present in carbonyl and/or ether groups. Examples of the operative R substituents are $-(CH_2)_3NHCH_2CH_2NH_2$, $-(CH_2)_4NHCH_2CH_2NHCH_3$, $-CH_2{\cdot}CH{\cdot}CH_3CH_2NHCH_2CH_2NH_2$, $-(CH_2)_3NHCH_2CH_2NHCH_2CH_2NH_2$, $$-(CH_2)_3NHCH_2CH_2\overset{\overset{\displaystyle CH_2CH_2NH_2}{|}}{C}H(CH_2)_3NH_2$$

and $-(CH_2)_3NH(CH_2)_2NHCH_2CH_2COOCH_3$. Each of the X substituents may be an alkoxy radical having from 1 to 14 carbon atoms, preferably from 1 to 4 carbon atoms. Examples of X radicals are methoxy, iso-propoxy, hexoxy and decyloxy. When present R′ may be any alkyl or aryl radical, preferably having less than 19 carbon atoms, e.g. methyl, ethyl, propyl, octyl or phenyl. Preferred as component (B) are the organosilanes having the general formula $RSiX_3$ wherein R represents the $-(CH_2)_3NHCH_2CH_2NH_2$ or the $-CH_2CHCH_3CH_2NHCH_2CH_2NH_2$ radicals and each X represents the methoxy or ethoxy radicals.

As component (C) of the compositions employed in the process of this invention there are employed substances having at least one hydroxyl radical attached to analiphatic carbon atom. Suitable hydroxylated substances include organic compounds and polymeric materials, for example monohydric and polyhydric alcohols e.g. n-hexyl alcohol, octyl, alcohol, nonyl alcohol, benzyl alcohol, 2-phenylethyl alcohol, glycerol and pentaerythritol, glycols and their monoethers e.g. ethylene glycol, propylene glycol and ethylene glycol monobutyl ether, linear and branched hydroxylated poly(alkylene oxides) e.g. diethylene glycol, polyethylene glycols, polypropylene glycols mixed polyethylene-polypropylene glycols, diethylene glycol monohexyl ether, and condensation products of alkylene oxides with polyhydroxy compounds e.g. condensation products of ethylene oxide with glycerol and pentaerythritol. The hydroxy radical or radicals may also be attached to an organic portion which is in turn attached to an organosilicon polymer. Examples of hydroxylated substances having such a molecular configuration are the siloxane-oxyalkylene block copolymers wherein the polyoxyalkylene blocks are terminated with hydroxyl radicals. Such copolymers are well known in the art and are employed for example as surfactants for the preparation of polyurethane foams. The preferred hydroxylated compounds are those which have at least one primary hydroxyl radical in the molecule. Most preferred are the primary hydroxyl-containing poly(alkylene oxides).

In the practice of this invention the product obtained by mixing components (A), (B) and (C) is applied to keratinous fibres. As described in German Offenlegungschrift No. 2,335,751, the preferred compositions for use according to the invention contain an additional component (D) which is (i) a silane of the general formula $R''_mSiZ_{4-m}$, wherein R'' is a hydrogen atom or a monovalent hydrocarbon radical or monovalent halogenated hydrocarbon radical, Z is an alkoxy or alkoxyalkoxy radical having from 1 to 4 inclusive carbon atoms and $m$ is 0 or 1, and/or (ii) a partial hydrolysate and condensate of the said silane. Compositions comprising (A), (B), (C) and (D) are novel and are included within the scope of this invention.

In general formula of the silane (i) R'' may be a hydrogen atom or a monovalent hydrocarbon radical or halogenated hydrocarbon radical, for example alkyl, e.g. methyl, ethyl, propyl, butyl, hexyl, decyl, octadecyl, alkenyl e.g. vinyl or allyl, aryl, aralkyl or alkaryl e.g. phenyl, tolyl or benzyl, halogenoalkyl e.g. chloromethyl, bromoethyl or 3,3,3-trifluoropropyl and halogenoaryl e.g. chlorophenyl. The radical Z may be for example methoxy, ethoxy, propoxy or methoxyethoxy. Preferably Z is methoxy or ethoxy and R'' when present, is methyl. Examples of the silanes (i) and their partial hydrolysis and condensation products (ii) are methyltrimethoxysilane, ethyltrimethoxysilane, n-propyltriethoxysilane, phenyltriethoxysilane, tetraethyl orthosilicate, n-butyl orthosilicate, ethyl polysilicate and siloxanes containing both silicon-bonded methyl radicals and methoxy radicals.

When components (A) and (B) are mixed at normal ambient or elevated temperatures they react, at least partially. It is also believed that at least one additional reaction involving (C) and (D) separately or jointly occurs when these two components are included in the treating composition. The product applied to the fibres will therefore comprise, at least in part, a reaction product rather than a simple mixture of components.

The relative proportions of the components (A) and (B) employed in the preparation of the compositions may vary between fairly wide limits. Preferably from 0.5 to 15 parts by weight of silane (B) per 100 parts by weight of (A) are employed, but proportions in excess of 15 parts of silane (B), for example up to 50 parts or more are operative. Component (D) is preferably employed in a proportion of from 1 to 20 per cent by weight based on the total weight of (A) and (B). Component (C) is employed in a proportion of from 1 to 15%, preferably from 2 to 10% by weight based on the total weight of (A) and (B) or, when (D) is present, of (A), (B) and (D).

When preparing the compositions of this invention the order of mixing the components is not critical. It is preferred to incorporate (D) into the mixture of (A) and (B) prior to dissolving the mixture in an organic solvent. It is also convenient to provide the compositions as a two package product, one package containing the polydiorganosiloxane (A) and the other package containing the product obtained by mixing (B), (C) and (D). When required for use the contents of the two packages may then be combined in the desired proportions and where applicable dissolved in the organic solvent carrier.

The compositions may be applied to the keratinous fibres by any suitable method e.g. padding dipping or spraying. They are however particularly adapted for application from an organic solvent solution employing a conventional dry cleaning machine or like batch treatment apparatus where the build up of cured siloxane can occur. Organic solvents which may be employed include the hydrocarbons and chlorinated hydrocarbons, for example toluene, xylene, white spirit and perchloroethylene, the latter being preferred.

Following the application of the composition the treated fibres are dried and the applied composition cured. Drying and curing may be carried out by merely exposing the treated fibres to the normal ambient atmosphere (about 20° C) for periods which may vary from about 2 hours to several days. If desired however, the drying and curing step may be expedited by the use of elevated temperatures, e.g. from 60° to 140° C. Curing is believed to be initiated by traces of water. Under normal conditions the moisture present in the atmosphere and/or in the applied composition is sufficient for this purpose. If necessary, however, the water content of the curing environment may be artificially supplemented.

The process of this invention finds application in the treatment of keratinous fibres to endow such fibres with a resistance to shrinkage on washing and also with a durable soft handle. The fibres may be treated in any form, for example as yarns, knitted or woven fabrics or made up garments. They may be present as the sole fibres or as blends with other types of fibre. Where improved handle of the treated fibres is the primary consideration, this may be achieved by depositing on the fabric as little as 0.1% of its weight of the composition. When a significant level of shrink resistance is required a somewhat higher level of application of the composition, e.g. from about 0.5 to 10% preferably from 1 to 5% is more appropriate. The percentage weight of composition applied to the fibres, as referred to herein, means the weight of active ingredients namely (A), (B) and (C) or (A), (B), (C) and (D), deposited on the fibres.

The following examples in which the parts are expressed by weight, illustrate the invention.

EXAMPLE 1

A composition was prepared by mixing together,

| | |
|---|---|
| Polydimethylsiloxane having terminal SiOH groups and m.wt = 45000 (3000 cS at 25° C) | 90 parts |
| $(CH_3O)_3Si(CH_2)_3NHCH_2CH_2NH_2$ | 10 parts |
| *Partial condensate of $CH_3Si(OCH_3)_3$ | 2 parts |

*The partial condensate was prepared by refluxing the silane with aqueous sodium hydroxide solution (0.25% NaOH) for 3 hours. The partial condensate was then recovered after neutralisation and removal of volatiles.

Three parts of the mixture was dissolved in 97 parts of perchloroethylene to provide a 3% stock solution. The conditions existing when the solution is employed to treat fabrics in a conventional dry cleaning machine were then simulated by the following procedure.

To each of 7 weighed aluminium dishes of approximately 5 cm. diameter was added 10 ml. of the solution. The dishes were then placed in an air circulating oven at 80° C for 30 minutes to remove the solvent and the procedure repeated four more times. After the fifth treatment the siloxane build up in the aluminium dishes had reached approximately 1.5 g. One of the weighed dishes and contents was placed in a closed container of perchloroethylene and the container shaken for 2 minutes. After exposure to the atmosphere for about 12 hours to allow residual perchloroethylene to evaporate the dish was again weighed and the unextracted weight of siloxane recorded. The remainder of the series of dishes were exposed to the normal ambient atmosphere (Relative Humidity approximately 60%) and at hourly intervals a dish was removed and treated as described above to determine the weight of unextractable material. A series of values was thus obtained indicating the change in percentage extractable material during a six hour cure period.

The procedure was carried out employing the stock solution as a control and also with samples of stock solution to which had been added 3%, 5% and 10%, based on the weight of siloxane and silane components, of an ethyleneoxypropyleneoxy block copolymer diol having a molecular weight of 2000. The results obtained are set out in the following table. They show that the presence of the diol retards the formation of insoluble siloxane.

| Solution | percentage Unextractable (Insoluble) Siloxane | | | | | | |
|---|---|---|---|---|---|---|---|
| | 0 hr. | 1 hr. | 2 hr. | 3 hr. | 4 hr. | 5 hr. | 6 hr. |
| Stock Solution | 9 | 81 | 92.5 | 98 | 99 | 99 | 99 |
| " " + 3% diol | 1 | 2 | 38 | 86 | 92 | 93 | 94 |
| " " + 5% diol | 1 | 2 | 5 | 10 | 86 | 93 | 93 |
| " " +10% diol | 1 | 2 | 5 | 12 | 90 | 95 | 96 |

The solutions were applied to samples of botany wool fabric, allowed to cure and the area felting shrinkage of the fabrics measured before and after washing in an International Cubex Machine according to International Wool Secretariat Specification W.S.S. 128, Test Method No. 185. It was found that at lower pick up levels, e.g. 2%, the presence of the diol resulted in an improvement in the degree of shrink resistance obtained when compared with the diol-free stock solution.

A number of batches of woolen articles were treated employing the stock solution described above in a commercial dry cleaning machine. Each batch of treating solution was modified before use by the addition of 5% of the block copolymer diol. It was found that build up of cured siloxane in the machine was significantly slower than that which occurred when no diol was present.

EXAMPLE 2

The procedure of Example 1 was repeated employing 5% by weight of n-hexanol or a polyethylene glycol (M.Wt.= 600) in place of the block copolymer diol. In both cases the addition of the hydroxylated compound resulted in the insoluble siloxane build-up being retarded.

EXAMPLE 3

A 3% stock solution was prepared as described in Example 1 from a composition obtained by mixing together,

| | |
|---|---|
| Polydimethylsiloxane having terminal SiOH groups and M.Wt = 45000 | 90 parts |
| $(C_4H_9O)_2(OCH_3)Si(CH_2)_3NHCH_2CH_2NH_2$ | 8.3 parts |
| Partial Condensate of $CH_3Si(OCH_3)_3$ | 1.7 parts |

The stock solution was then subjected to the test procedure described in Example 1, the diol used in that Example being added in proportions of 3%, 5% and 10% by weight. In all cases addition of the diol resulted in a retardation of siloxane build-up.

That which is claimed is:

1. A process for the treatment of keratinous fibres which comprises applying thereto from 0.1 to 10% by weight of a composition comprising the product obtained by mixing (A) a polydiorganosiloxane having terminal silicon-bonded hydroxyl radicals and a molecular weight of at least 750, at least 50% of the organic substituents in the polydiorganosiloxane being methyl radicals, any other organic substituents being monovalent hydrocarbon radicals having from 2 to 30 carbon atoms, (B) an organosilicon compound selected from the group consisting of organosilanes of the general formula $RSiR'_nX_{3-n}$ wherein R represents a monovalent radical composed of carbon, hydrogen, nitrogen and, optionally, oxygen, which radical contains at least two amine groups and is attached to silicon through a silicon to carbon linkage, R' represents an alkyl radical or an aryl radical, each X represents an alkoxy radical having from 1 to 14 inclusive carbon atoms and $n$ is 0 or 1, and partial hydrolysates and condensates of said organosilanes, and (C) from 1 to 15% by weight based on the total weight of (A) and (B) of an organic or organosilicon compound containing at least one hydroxyl radical attached to an aliphatic carbon atom, and thereafter curing the applied composition.

2. A process as claimed in claim 1 wherein the polydiorganosiloxane is a polydimethylsiloxane.

3. A process as claimed in claim 1 wherein (B) is employed in a proportion of from 0.5 to 15% by weight based on the weight of (A).

4. A process as claimed in claim 1 wherein there is also incorporated into the composition a component (D) which is selected from the group consisting of (i) silanes of the general formula $R''_mSiZ_{4-m}$ wherein R'' represents a hydrogen atom or a monovalent hydrocarbon or halogenated hydrocarbon radical having from 1 to 18 carbon atoms, Z is an alkoxy radical having from 1 to 4 carbon atoms or an alkoxyalkoxy radical having from 2 to 4 carbon atoms and *m* is 0 or 1, and (ii) partial hydrolysates and condensates of said silane (i).

5. A process as claimed in claim 4 wherein (D) is incorporated in a proportion of from 1 to 20% by weight based on the total weight of (A) and (B).

6. A process as claimed in claim 1 wherein (C) has at least one primary hydroxyl radical in the molecule.

7. A process as claimed in claim 6 wherein (C) is a hydroxyl-containing poly(alkylene oxide).

* * * * *

UNITED STATES PATENT AND TRADEMARK OFFICE

CERTIFICATE OF CORRECTION

PATENT NO. : 4,005,231

DATED : January 25, 1977

INVENTOR(S) : CHARLES SMITH

It is certified that error appears in the above-identified patent and that said Letters Patent are hereby corrected as shown below:

Column 1, line 32, "fount" should read --found--

Column 2, line 68, "analiphatic" should read --an aliphatic--

Column 3, line 41, "In general" should read --In the general--

Column 5, first table, line 1, should read --Polydimethylsiloxane having terminal ≡SiOH--

Column 6, first table, line 1, should read --Polydimethylsiloxane having terminal ≡SiOH--

Signed and Sealed this

*Eighth* Day of *July 1980*

[SEAL]

*Attest:*

SIDNEY A. DIAMOND

*Attesting Officer*

*Commissioner of Patents and Trademarks*